United States Patent [19]

Tomita et al.

[11] Patent Number: 4,758,489

[45] Date of Patent: Jul. 19, 1988

[54] TONER FOR DEVELOPING LATENT ELECTROSTATIC IMAGES

[75] Inventors: Masami Tomita, Numazu; Satoru Inoue, Mishima; Akio Matsui, Namazu; Toshiki Nanya, Numazu; Fumihiro Sasaki, Numazu, all of Japan

[73] Assignee: Ricoh Company, Ltd., Tokyo, Japan

[21] Appl. No.: 897,153

[22] Filed: Aug. 18, 1986

[30] Foreign Application Priority Data

Aug. 29, 1985 [JP] Japan ..... 60-188471

[51] Int. Cl.[4] ..... G03G 9/08

[52] U.S. Cl. ..... 430/106

[58] Field of Search ..... 430/106

[56] References Cited

U.S. PATENT DOCUMENTS 4,301,227 11/1981 Hotta et al. ..... 430/106

4,530,893 7/1985 Maekawa et al. ..... 430/106

FOREIGN PATENT DOCUMENTS 59-220750 12/1984 Japan ..... 430/106

59-219756 12/1984 Japan ..... 430/106

*Primary Examiner*—Roland E. Martin

*Attorney, Agent, or Firm*—Oblon, Fisher, Spivak, McClelland & Maier

[57] ABSTRACT

A red toner for developing latent electrostatic images is disclosed which comprises a binder agent, C.I. Pigment Red 48 and C.I. Pigment Red 81.

5 Claims, No Drawings

TONER FOR DEVELOPING LATENT ELECTROSTATIC IMAGES

BACKGROUND OF THE INVENTION

The present invention relates to a one-component toner for use with a development unit in which a toner thin layer is formed on a toner transportation member, and more particularly to a one-component positive charging red toner for use with a development unit provided with a toner transportation member and a toner layer thickness regulating device which may flexibly come into contact with the toner transportation member.

Recently, a demand for an electrophotographic copying system capable of making multi-colored copies from multi-colored originals is increasing. This is because multi-colored copies with many colors in addition to a black color are readily understandable when tables, graphs and figures are copied, and more information can be included as compared with mono-chrome copies.

As a coloring agent for use in color toners except a black toner, in particular, for use in red toners, rhodamine-type pigments and quinacridone-type pigments (as disclosed in Japanese Laid-Open Patent Application No. 51-144625) and mono-azo pigments (as disclosed in Japanese Laid-Open Patent Application No. 56-140357) are proposed. These pigments, however, are not capable of yielding a satisfactory red color tone and are not suitable for use in the toner designed to have stable positive charging properties.

When a conventional red color toner for developing latent electrostatic images is used in a development unit provided with a toner layer thickness regulating device, a sufficient positive charge cannot be maintained in the toner and the background of the copies is apt to be conspicuously deposited with the toner, so that it is difficult to obtain clear images.

Furthermore, since a conventional polarity controlling agent for positive charging is usually black or nearly black in color, pure red images cannot be obtained even if a small amount of such polarity agent is contained in the red toner.

SUMMARY OF THE INVENTION

It is therefore an object of the present invention to provide a one-component positive charging toner from which the above-mentioned problems of the conventional toners have been eliminated, and which is capable of retaining a positive charge in a stable manner even if it is used continuously or in repetition, and yielding pure red images.

In order to achieve the above-mentioned object of the present invention, the toner according to the present invention comprises a binder agent and a combination of C.I. Pigment Red 48 and C.I. Pigment Red 81 (which color indexes are cited from the third edition of the Color Index).

DETAILED DESCRIPTION OF THE PREFERRED EMBODIMENTS

As mentioned above, in the toner according to the present invention, two types of red pigments, C.I. Pigment Red 48 and C.I. Pigment Red 81, are used in combination. In order to obtain an appropriate color tone, a positive charge controlling effect and image fixing properties, it is preferable that the total amount of the red pigments be in the range of 0.1 to 50 wt. %, more preferably in the range of 2 to 20 wt. %. It is preferable that the amount ratio by weight of C.I. Pigment Red 48 to C.I. Pigment Red 81 be in the range of (2:8) to (8:2).

As the binder agent for use in the present invention, resins employed for use in the conventional toners for electrophotography can be employed. Examples of such resins are polymers and copolymers, such as polystyrene, chlorinated paraffin, polyvinyl chloride, phenol resin, epoxy resin, polyester, polyamide, polyacrylic acid resin, polyethylene and polypropylene. These can be used alone or in combination.

Further, various types of conventionally known dyes and pigments can be added to the above components in order to control the color tone of the images to be developed.

The toner according to the present invention is prepared as follows. The above materials are mixed in accordance with a predetermined formulation and fused and kneaded in a mill. After the mixture is cooled, it is crushed in a hammer mill, ground to fine particles in a jet mill and was then subjected to classification by a pneumatic classifier, so that toner particles having a particle size ranging from about 5 μm to about 20 μm are obtained, whereby a toner according to the present invention is prepared.

The present invention will now be explained in detail with reference to the following examples:

EXAMPLE 1

[Formulation of Toner No. 1]

| | Parts by Weight |
|---|---|
| Styrene - acrylic acid copolymer (Himer SBM-73 made by Sanyo Chemical Industries, Ltd.) | 88 |
| Low molecular weight polypropylene (Weight average molecular weight: about 8000) | 5 |
| C.I. Pigment Red 48 (Fast Red 2E made by Sanyo Color Works, Ltd.) | 4 |
| C.I. Pigment Red 81 (#44 Fast Rose made by Dainichi Seika Color and Chemicals Mfg. Co., Ltd.) | 3 |

A mixture of the above components was heated and kneaded in a thermic roll mill at temperatures ranging from 120° C. to 130° C. for about 30 minutes. After the kneaded mixture was cooled to room temperature, it was roughly ground in a grinding machine and was then further ground to fine particles, followed by subjecting the fine particles to classification so as to obtain toner particles having a particle size ranging from 5 μm to 15 μm, whereby Toner No. 1 according to the present invention was prepared.

The above obtained Toner No. 1 was placed in a development unit of a commercially available electrophotographic copying machine, provided with a toner transportation member and a toner layer thickness regulating device (made of brass) disposed so as to come into contact with the toner transportation member, so that a continuous copying test was performed for investigating the image formation performance and the durability of the toner.

A latent electrostatic image was formed on the organic photoconductor of the copying machine by uniformly charging the photoconductor to a negative polarity with application thereto of −800 volts in the dark, followed by exposing the photoconductor to a light image. The thus formed latent electrostatic image was developed with the above Toner No. 1 to a visible toner image, followed by the transfer of the visible toner image to a conventional copy sheet. By repeating the above process, a continuous copying test was conducted. The result was that the obtained images were excellent in image quality and there was no difference in image quality between the first image and the images obtained after the 20,000th copy in the course of the continuous copying test. Furthermore, the images were free from the toner deposition on the background and image spreading, so that excellent copies with pure red image were obtained.

COMPARATIVE EXAMPLE 1

Example 1 was repeated except that the C.I. Pigment Red 48 employed in Example 1 was replaced by C.I. Pigment Red 17 (Pigment Red A made by Dainichi Seika Color and Chemicals Mfg. Co., Ltd.), whereby Comparative Toner No. 1 was prepared. Comparative Toner No. 1 was subjected to the same continuous copying test as in Example 1. The result was that the toner deposition on the background was slight in the initial stage of the copying test, but it became conspicuous after the 1,000th copy and image spreading was also observed.

EXAMPLE 2

[Formulation of Toner No. 2]

| | Parts by Weight |
|---|---|
| Polystyrene (Piccolastic D-125 made by Esso Sekiyu K.K.) | 85 |
| Low molecular weight polyethylene (Weight average molecular weight: about 10,000) | 4 |
| C.I. Pigment Red 48 (Sumikaprint Red C made by Sumitomo Chemical Co., Ltd.) | 6 |
| C.I. Pigment Red 81 (#33 Fast Rose made by Dainichi Seika Color and Chemicals Mfg. Co., Ltd.) | 5 |

Example 1 was repeated except the formulation in Example 1 was replaced by the above formulation, whereby Toner No. 2 according to the present invention was prepared. Toner No. 2 was subjected to the same continuous copying test as in Example 1. The result was that Toner No. 2 was as excellent in the image formation performance as Toner No. 1 prepared in Example 1.

EXAMPLE 3

[Formulation of Toner No. 3]

| | Parts by Weight |
|---|---|
| Styrene - acrylic acid copolymer (Himer SBM-73 made by Sanyo Industries, Ltd.) | 88 |
| Low molecular weight polypropylene (Weight average molecular weight: about 8000) | 4 |
| C.I. Pigment Red 48 (Fast Red 2BE) | 5 |
| C.I. Pigment Red 81 (#40 Fast Rose made by Dainichi Seika Color and Chemicals Mfg. Co., Ltd.) | 3 |

Example 1 was repeated except the formulation in Example 1 was replaced by the above formulation, whereby Toner No. 3 according to the present invention was prepared. Toner No. 3 was subjected to the same continuous copying test as in Example 1. The result was that Toner No. 2 was as excellent in the image formation performance as Toner No. 1 prepared in Example 1.

COMPARATIVE EXAMPLE 2

Example 1 was repeated except that C.I. Pigment Red 81 employed in Example 1 was replaced by C.I. Pigment Red 239 (Pigment Red 4BS made by Sanyo Color Works, Ltd.), whereby Comparative Toner No. 2 was prepared. Comparative Toner No. 2 was subjected to the same continuous copying test as in Example 1. The result was that there was no problem in the toner deposition on the background at the initial stage of the copying test, but the toner deposition became conspicuous after the 1,500th copy and image spreading was also observed.

COMPARATIVE EXAMPLE 3

[Formulation of Toner]

| | Parts by Weight |
|---|---|
| Styrene - acrylic acid copolymer (Himer-SBM-73 made by Sanyo Chemical Industries, Ltd.) | 90 |
| Low molecular weight polypropylene (Weight average molecular weight: about 8000) | 5 |
| C.I. Pigment Red 48 (Fast Red 2BE) | 5 |

Example 1 was repeated except the formulation in Example 1 was relaced by the above formulation in which only C.I. Pigment Red 48 was used instead of using both C.I. Pigment Red 48 and C.I. Pigment Red 81, whereby Comparative Toner No. 3 was prepared. Comparative Toner No. 3 was subjected to the same continuous copying test as in Example 1. The result was that initially the obtained images were clear, but toner deposition on the background appeared after the 20,000th copy in the course of the continuous copying test. The obtained color tone was orange-yellow rather than red.

COMPARATIVE EXAMPLE 4

[Formulation of Toner]

| | Parts by Weight |
|---|---|
| Styrene-acrylic copolymer (Himer-SBM-73, made by Sanyo Chemical Industries, Ltd.) | 90 |
| Low molecular weight polypropylene (Weight average molecular weight: about 8000) | 5 |
| C.I. Pigment Red 81 (#44 Fast Rose) | 55 |

Example 1 was repeated except the formulation in Example 1 was relaced by the above formulation in which only C.I. Pigment Red 48 was used instead of using both C.I. Pigment Red 48 and C.I. Pigment Red 81, whereby Comparative Toner No. 3 was prepared. Comparative Toner No. 3 was subjected to the same continuous copying test as in Example 1. The result was that initially the obtained images were clear, but slight toner deposition on the background appeared after the 20,000th copy in the course of the continuous copying test. The obtained color tone was magenta rather than red.

The hue errors of the images obtained in Examples 1 through 3 according to the present invention and Comparative Examples 1 through 4 were investigated. In terms of the hue error of red, when the hue error of the color is 90 or more, such color is recognized as red. The hue error is defined by the following equation:

$$\text{Hue Error} = \frac{M - L}{H - L} \times 100$$

where H is the maximum density of the densities of three colors measured by a Macbeth densitometer through blue, green and red filters, respectively; M is the medium density of the above three densities; and L is the minimum density of the above three densities.

The following table shows the hue error and the image quality of each of the images obtained by Toners No. 1 through No. 3 according to the present invention and Comparative Toners No. 1 through No. 4.

| | Hue Error | Image Quality in Continuous Copying |
|---|---|---|
| Example 1 | 98 | No toner deposition on the background and no image spreading even after 20,000 copies |
| Example 2 | 96 | No toner deposition on the background and no image spreading even after 20,000 copies |
| Example 3 | 98 | No toner deposition on the background and no image spreading even after 20,000 copies |
| Comparative Example 1 | 97 | Toner deposition on the background and image spreading apppeared after 1,000 copies |
| Comparative Example 2 | 96 | Toner deposition on the background and image spreading appeared after 1,500 copies |
| Comparative Example 3 | 80 | Toner deposition on the background and image spreading appeared after 20,000 copies |
| Comparative Example 4 | 80 | Slight toner deposition on the background appeared after 20,000 copies |

The above results indicate that the toners according to the present invention have stable positive chargeability and are capable of yielding clear and pure red images, even if the toners are used continuously or in repetition for development.

What is claimed is:

1. A red toner comprising a binder agent, C.I. Pigment Red 48 and C.I. Pigment Red 81.

2. The red toner as recited in claim 1, wherein the total content of said C.I. Pigment Red 48 and said C.I. Pigment Red 81 is in the range of 0.1 wt. % to 50 wt. % of the total weight of said red toner.

3. The red toner as recited in claim 1, wherein the amount ratio by weight of said C.I. Pigment Red 48 to said C.I. Pigment Red 81 is in the range of (2:8) to (8:2).

4. The red toner as recited in claim 2, wherein the amount ratio by weight of said C.I. Pigment Red 48 to said C.I. Pigment Red 81 is in the range of (2:8) to (8:2).

5. The red toner as recited in claim 1, wherein said binder agent is selected from the group consisting of polystyrene, chlorinated paraffin, polyvinyl chloride, phenol resin, epoxy resin, polyester, polyamide, polyacrylic acid resin, polyethylene and polypropylene.

* * * * *